US011359895B2

(12) United States Patent
Kennedy

(10) Patent No.: US 11,359,895 B2
(45) Date of Patent: Jun. 14, 2022

(54) SUPERCHARGED ACCELERATING PROJECTILE FIRED IN A FLIGHT TRAJECTORY TOWARDS A TARGET

(71) Applicant: Darren J. Kennedy, Beloit, WI (US)

(72) Inventor: Darren J. Kennedy, Beloit, WI (US)

( * ) Notice: Subject to any disclaimer, the term of this patent is extended or adjusted under 35 U.S.C. 154(b) by 0 days.

(21) Appl. No.: 17/114,417

(22) Filed: Dec. 7, 2020

(65) Prior Publication Data

US 2021/0302141 A1 Sep. 30, 2021

Related U.S. Application Data

(63) Continuation-in-part of application No. 16/883,164, filed on May 26, 2020, now abandoned.

(60) Provisional application No. 62/857,255, filed on Jun. 4, 2019.

(51) Int. Cl.
*F42B 10/40* (2006.01)
*F42B 14/06* (2006.01)

(52) U.S. Cl.
CPC ..... *F42B 10/40* (2013.01); *F42B 14/064* (2013.01)

(58) Field of Classification Search
CPC ..... F42B 10/40; F42B 10/38; F42B 14/064; F42B 10/32; F42B 10/34
USPC ..... 102/521, 522, 439
See application file for complete search history.

(56) References Cited

U.S. PATENT DOCUMENTS 3,186,342 A * 6/1965 Hancock, Jr. ..... F42B 14/064 102/523
4,239,006 A * 12/1980 Kelson ..... F42B 14/04 102/511
4,296,687 A * 10/1981 Garrett ..... F42B 14/064 102/518
2018/0335285 A1* 11/2018 Gizowski ..... F42B 30/02

* cited by examiner

*Primary Examiner* — Reginald S Tillman, Jr.
(74) *Attorney, Agent, or Firm* — Lamon Patent Services; Cynthia S. Lamon

(57) ABSTRACT

A projectile system has a projectile with a metal body having a first outside diameter, a forward end and a rearward end, a plastic base wad engaged at the rearward end, the plastic base wad of solid plastic having a first length and a second outside diameter, greater than the first outside diameter, and a rifled barrel having a third inside diameter at the tips of the rifling, the third inside diameter greater than the first outside diameter but less than the second outside diameter, and a fourth diameter at the root of the rifling greater than the second outside diameter. With the projectile translating along the rifled barrel, the metal body passes inside the rifling, avoiding metal to metal friction, while the plastic base wad fully engages the rifling, imparting rotation to the metal projectile.

11 Claims, 5 Drawing Sheets

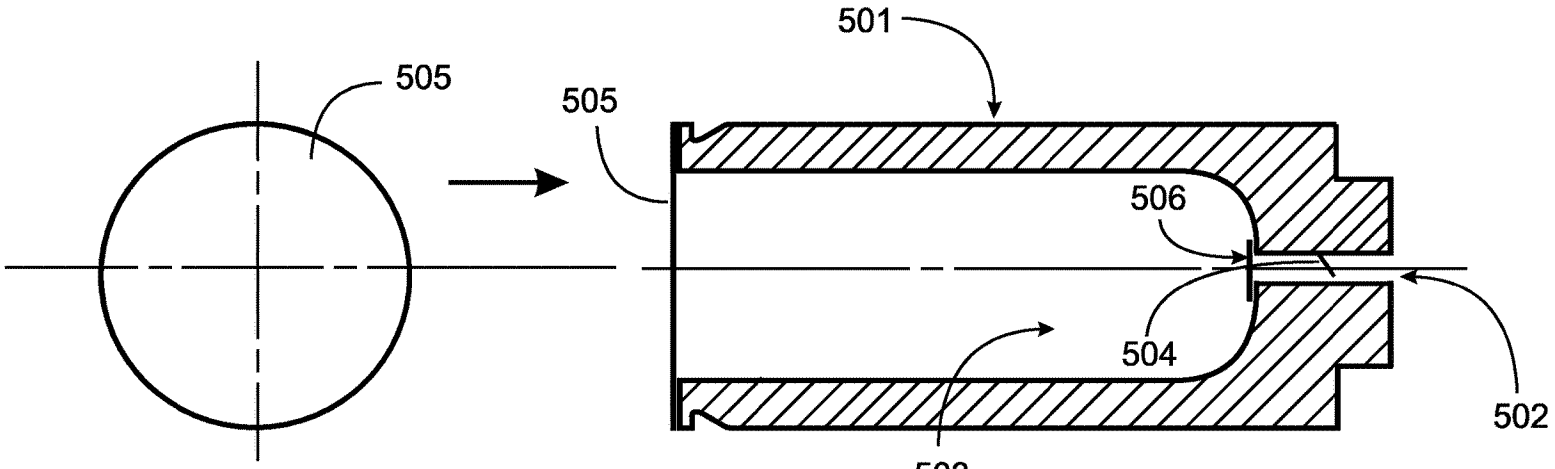
Fig. 5A
Fig. 5B
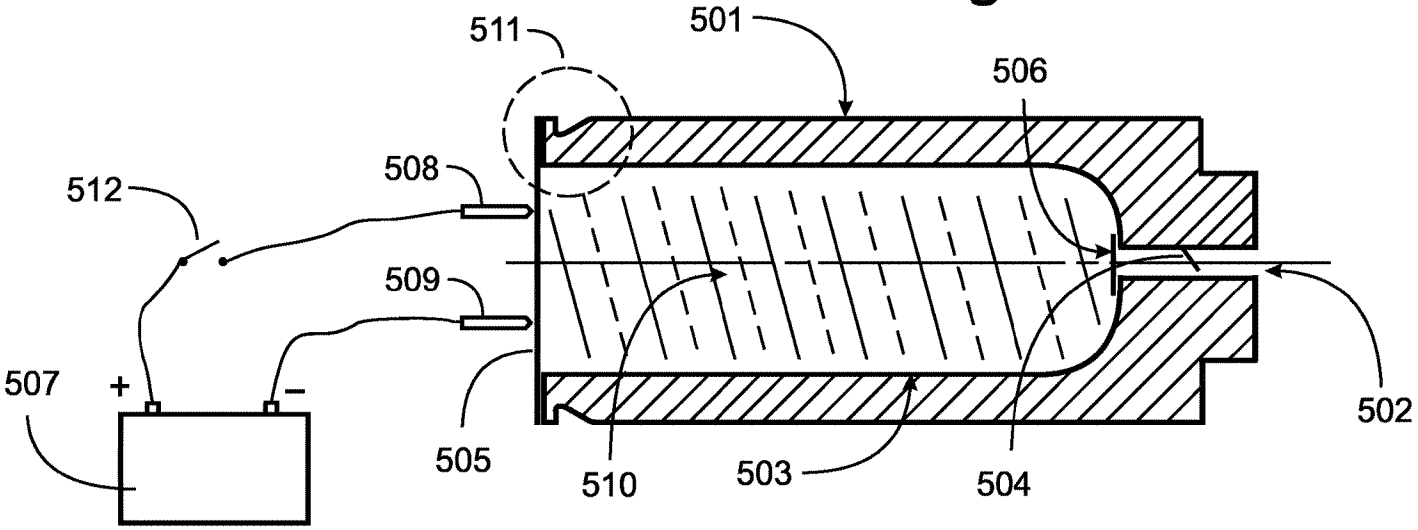
Fig. 5C

SUPERCHARGED ACCELERATING PROJECTILE FIRED IN A FLIGHT TRAJECTORY TOWARDS A TARGET

CROSS-REFERENCE TO RELATED APPLICATIONS

The instant application is a Continuation-in-part of co-pending application Ser. No. 16/883,164, filed May 26, 2020, which claims priority to a provisional application 62/857,255 filed Jun. 4, 2019. Disclosure of the parent applications are incorporated herein at least by reference.

BACKGROUND OF THE INVENTION

1. Field of the Invention

The instant invention is in the technical area of projectiles fired from rifled barrels.

2. Description of Related Art

Large bore military guns and fully automatic machine guns incur a great reduction in rapid fire ability in the rifled barrel configuration due to heat buildup. The heat buildup is at least due to the friction in firing metal projectiles that engage the barrel rifling to create a gas seal and to provide rotation of the projectile from the rifled barrel. Another commonality with conventional projectiles is that the projectiles are base-heavy, which can cause tumbling. Additionally, the present invention eliminates common problems with ejection cycles thereby making the weapon more reliable. The injection cycle is the root of most weapon failures, the ejection components fail, for example the cartridge/case gets caught in the chamber, and jams or gets deformed by the ejection hardware and does not exit the chamber smoothly. The present invention eliminates case ejection. during firing.

What is clearly needed is an enhanced projectile that does not engage metal-to-metal with rifling grooves, and still imparts spin to the projectile.

BRIEF SUMMARY OF THE INVENTION

In an embodiment of the instant invention a projectile system is provided comprising a projectile with a metal body having a first outside diameter, a forward end and a rearward end, a plastic base wad engaged at the rearward end, the plastic base wad of solid plastic having a first length and a second outside diameter, greater than the first outside diameter, and a rifled barrel having a third inside diameter at the tips of the rifling, the third inside diameter greater than the first outside diameter but less than the second outside diameter, and a fourth diameter at the root of the rifling greater than the second outside diameter. With the projectile translating along the rifled barrel, the metal body passes inside the rifling, avoiding metal to metal friction, while the plastic base wad fully engages the rifling, imparting rotation to the metal projectile.

In one embodiment the system further comprises a forward tip of explosive material or depleted uranium. Also, in one embodiment the system further comprises a central cavity in the metal body and a central bore in the plastic base wad, such that expanding gas in firing the projectile with the base wad enter and pressurize the central cavity in the metal body while the projectile passes along the rifled barrel. In one embodiment the system further comprises a one-way valve in the central bore in the plastic base wad, allowing gas into the central cavity of the metal body, but preventing gas from exiting the cavity through the central bore. And in one embodiment the plastic base wad has a second length greater than the first length, an internal cavity filled with explosive material, wherein the central bore of the base wad is at a forward end of the internal cavity, and an ignition system adapted to ignite the explosive material in the internal cavity of the base wad.

In one embodiment of the system the central bore of the base wad is sealed with tape, and a rearward end of the base wad is covered with magnesium foil. And in one embodiment the ignition system comprises two electrodes in contact with the magnesium foil, the electrodes connected to opposite terminals of a battery through an ignition switch, such that closing the ignition switch closes an electric circuit through the magnesium foil, igniting the explosive material.

In another aspect of the invention a method for delivering an explosive device or an armor-penetrating element to a target is provided, comprising incorporating the explosive device or armor-penetrating element in a tip of a metal body of a projectile, the metal body having a first outside diameter, a forward end and a rearward end, engaging a plastic base wad at the rearward end of the metal body, the plastic base wad of solid plastic having a first length and a second outside diameter, greater than the first outside diameter, placing the combination of the metal body and the plastic base wad in a first end of a rifled barrel having a third inside diameter at the tips of the rifling, the third inside diameter greater than the first outside diameter but less than the second outside diameter, and a fourth diameter at the root of the rifling greater than the second outside diameter, and igniting an explosive charge to propel the combination of the metal body and the plastic base wad along the rifled barrel. With the projectile translating along the rifled barrel, the metal body passes inside the rifling, avoiding metal to metal friction, while the plastic base wad fully engages the rifling, imparting rotation to the combination of the metal body and the plastic base wad.

In one embodiment of the method the metal body has a central cavity and the base wad has a central bore, further comprising pressurizing the central cavity in the metal body by the expanding gas in firing the projectile through the central bore in the base wad while the projectile passes along the rifled barrel. Also, in one embodiment the central bore in the plastic base wad has a one-way valve, allowing gas into the central cavity of the metal body, but preventing gas from exiting the cavity through the central bore, and the method further comprises trapping gas in the central cavity by virtue of the one way valve.

In one embodiment of the method the plastic base wad has a second length greater than the first length, an internal cavity filled with explosive material, wherein the central bore of the base wad is at a forward end of the internal cavity, and an ignition system adapted to ignite the explosive material in the internal cavity of the base wad, and the method further comprises igniting the explosive material, driving the combination of the metal body and base wad along the rifled barrel.

In one embodiment of the method the central bore of the base wad is sealed with tape, and a rearward end of the base wad is covered with magnesium foil, and the method further comprises igniting the explosive material by closing an ignition switch in wiring connecting electrodes in contact with the magnesium foil. And in one embodiment the method further comprises driving the combination metal body and plastic base wad along the rifled barrel, compressing gas in the central cavity of the metal body, until the combination exits the rifled barrel, whereupon the plastic base wad ejects from the metal body, and the compressed gas in the central cavity further propels the metal body toward the target.

BRIEF DESCRIPTION OF THE SEVERAL VIEWS OF THE DRAWINGS

FIG. 5A illustrates a circular film of magnesium foil for sealing an end of a base wad in an embodiment of the invention.

FIG. 5B illustrates an alternative base wad in an embodiment of the invention.

FIG. 5C shows the base wad of FIG. 5A charged with explosive powder and sealed, as well as a means of ignition.

DETAILED DESCRIPTION OF THE INVENTION

Figure 1:
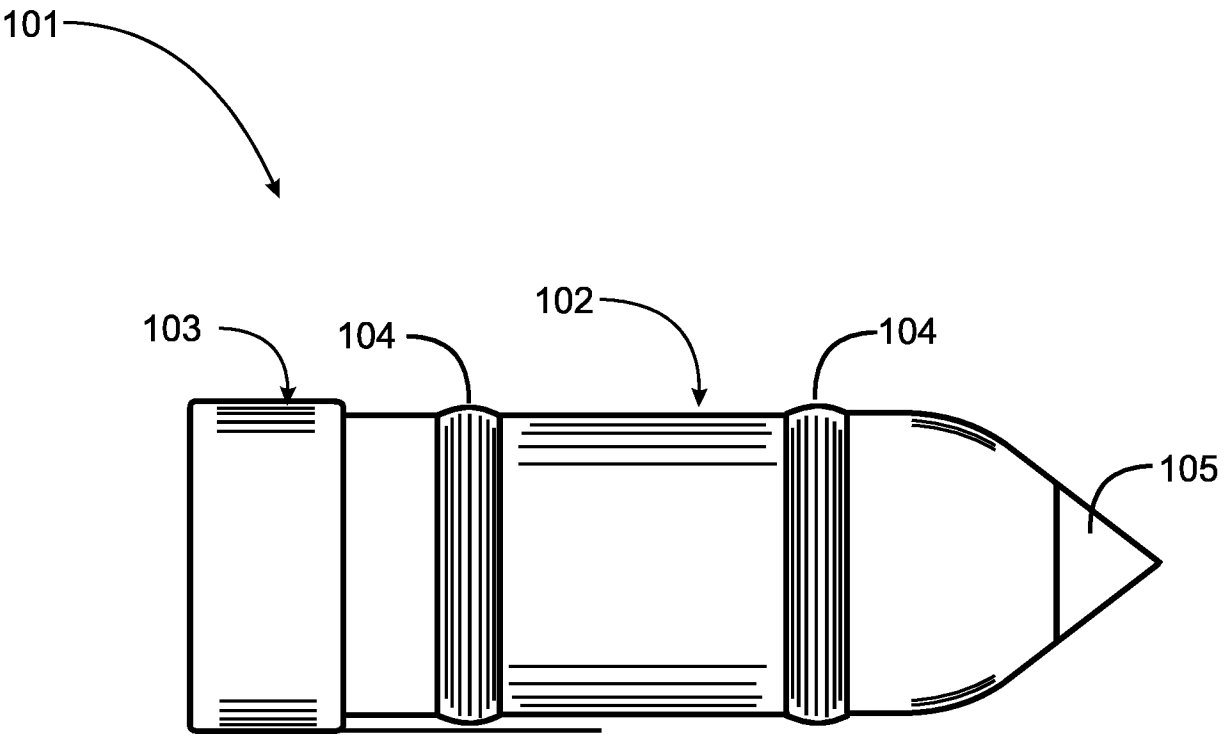
FIG. 1 is a side view of a combination projectile in an embodiment of the present invention.

In an embodiment of the instant invention a supercharged projectile is provided. Metal of this supercharged projectile is of a diameter that it rides lightly on the base inside diameter of a rifled barrel just as though it were going down a smooth bore. The supercharged projectile comprises a locked-in base wad to the projectile via pressed fit or locking lugs. The base wad is a polymer material and of a slightly larger diameter than the OD of the metal portion of the projectile. The polymer base wad, by virtue of the larger diameter, engages the rifling in the barrel and imparts rotation to the metal projectile. The plastic base wad fully engages the rifling and creates a low friction gas seal as well as rotating the projectile down the bore. The plastic base wad protects the chamber and the rifling from extreme heat erosion, and, by virtue of substantially reduced heating, enables more rapid and sustained firing.

Combination projectiles in embodiments of this invention store energy in the form of compressed superheated gasses from a gun chamber inside the bullet. This energy is metered via a gas metering hole in the base wad. This gas metering buffers a high chamber pressure spike allowing for more powder explosive to be used. The metering hole meters amount of pressure in the bullet gas chamber so as not to separate the base wad mid barrel.

The metering hole may have a one way-valve which may be of a reed type or other actuator valve to hold the pressure in the bullet gas chamber. After the supercharged projectile exits the barrel, the supercharged gasses act to blow off the base wad, further accelerating the projectile and exposing a projectile boat tail. This action makes the projectile much more aerodynamic in flight than if the base wad remained attached. The exiting gasses that accelerate the projectile also fill any void behind the projectile, thereby reducing drag and increasing the aerodynamic qualities of the projectile.

Raised radial belting is implemented on the projectile to lightly engage the rifled barrel bore inside diameter. In one embodiment the diameter of the radial belting is about three times the bore inside diameter. This belting implementation ensures minimal contact and reduces friction on the rifled bore by not incorporating the entire projectile to create a gas seal, as is conventional practice. The radial tangent that is flattened is very small, centering the projectile perfectly in the bore inside diameter. The radial belting is also more aerodynamic in flight.

The base wad in one embodiment is made of high-density plastic or Victrex Peek 450G plastic and seals the bore behind the projectile by fully engaging the bore rifling grooves. The base wad may, in one embodiment, contain an explosive propellant with a lengthened shell and a cross brace to the rear to hold either a conventional primer or an electric ignition device. This feature eliminates the need for ejecting a case, which ejection is common in prior practice. The base wad replaces the case and exits the barrel before being ejected from the projectile down range.

Lengthening the projectile creates a longer and bigger area in the gas chamber. A forward plastic insert tip may be pressed in from the rear and creates a lightweight forward gas seal for the gas chamber of the projectile. There may also be a ballistic tip of preference, or explosives, or depleted uranium for military large projectiles. Projectiles according to embodiments of the invention may be used for Tank and military large caliber shells, as well as for rifle, shotgun, black powder gun and air guns. The air gun and black powder rifles using the simple base wad with the gas metering hole. Tank projectiles with up to 83,000 PSI need a charged base wad to be reinforced with carbon fiber and overcast with high density plastic. This prevents the base wad from exploding on exit and give a first power exchange boost as gasses exit the wad outside of the barrel for a stage one acceleration. Then the stage two acceleration will occur with the disposal of the base wad from the projectile.

Figure 2:
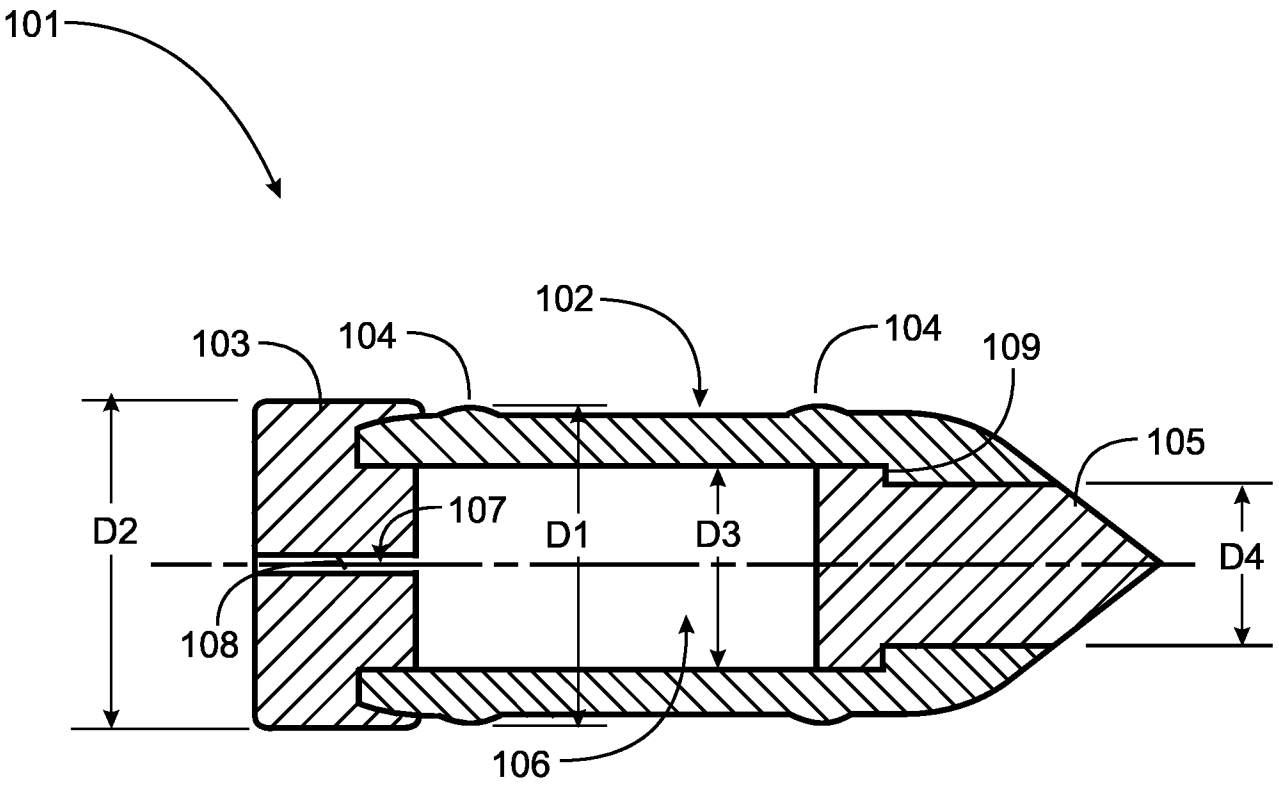
FIG. 2 is a longitudinal cross-section of the projectile of FIG. 1.

FIG. 1 is a side view of a supercharged accelerating projectile 101 in an embodiment of the instant invention, comprising a metal projectile body 102 having, in this particular embodiment, two instances of circumferential belting shape 104, of a slightly larger diameter D1 than the general outside diameter of body 102. There is forward tip 105 that may be explosive material or such as depleted uranium for piercing armor. A plastic base wad 103 engages the rear of metal body 102, FIG. 2 is a longitudinal section of projectile 102. Metal body 102 is open at both forward and rearward ends and has a bore of diameter D3 from the rear ending at a shoulder 109, with a smaller bore of diameter D4 proceeding to the open forward end. A plastic base wad 103 is pressed into the open rearward end of the metal body 102. Base wad 103 has a diameter D2 which is slightly larger than diameter D1 over the raised belting. Forward tip 105, that may be explosive material or such as depleted uranium for piercing armor, is engaged in the open forward opening of body 102 up against shoulder 109 creating an internal chamber 106.

The instances of raised belting 104 at diameter D1 are slightly smaller in diameter as the inside diameter of a rifled barrel for which the projectile is intended. This diameter enables the metal body to proceed along a rifled barrel as though it were instead a smooth bore. Plastic base wad 103 has an outside diameter D2 that is larger than D1, such that the base wad fully engages the rifling grooves of the barrel, forming a gas seal behind the projectile, and imparting rotation to the metal body when driven along the rifled barrel without the metal body engaging the rifling grooves.

Base wad 103 has a central bore 107 that serves as a gas metering hole to pressurize volume 106 from expanding gases used in propelling the projectile. In the embodiment of FIGS. 1 and 2 an explosive charge in the barrel is ignited to propel the projectile from the barrel. This charge is in this instance conventional and is not described here. The explosive charge when ignited drives the projectile along the barrel, and the expanding gases also pressurize volume 106 in the projectile through central bore 107. In one embodiment a one way-valve 108, which may be of a reed type or other actuator valve, is implemented to hold the pressure in the chamber 106.

After the projectile of FIG. 1 exits the rifled barrel the pressurized gas in volume 106 blow the base wad away from the metal body, the gas expands to the rear further propelling the projectile and eliminating any back draft. The free shell is now front heavy, an improvement for trajectory over conventional shells.

Figure 3:
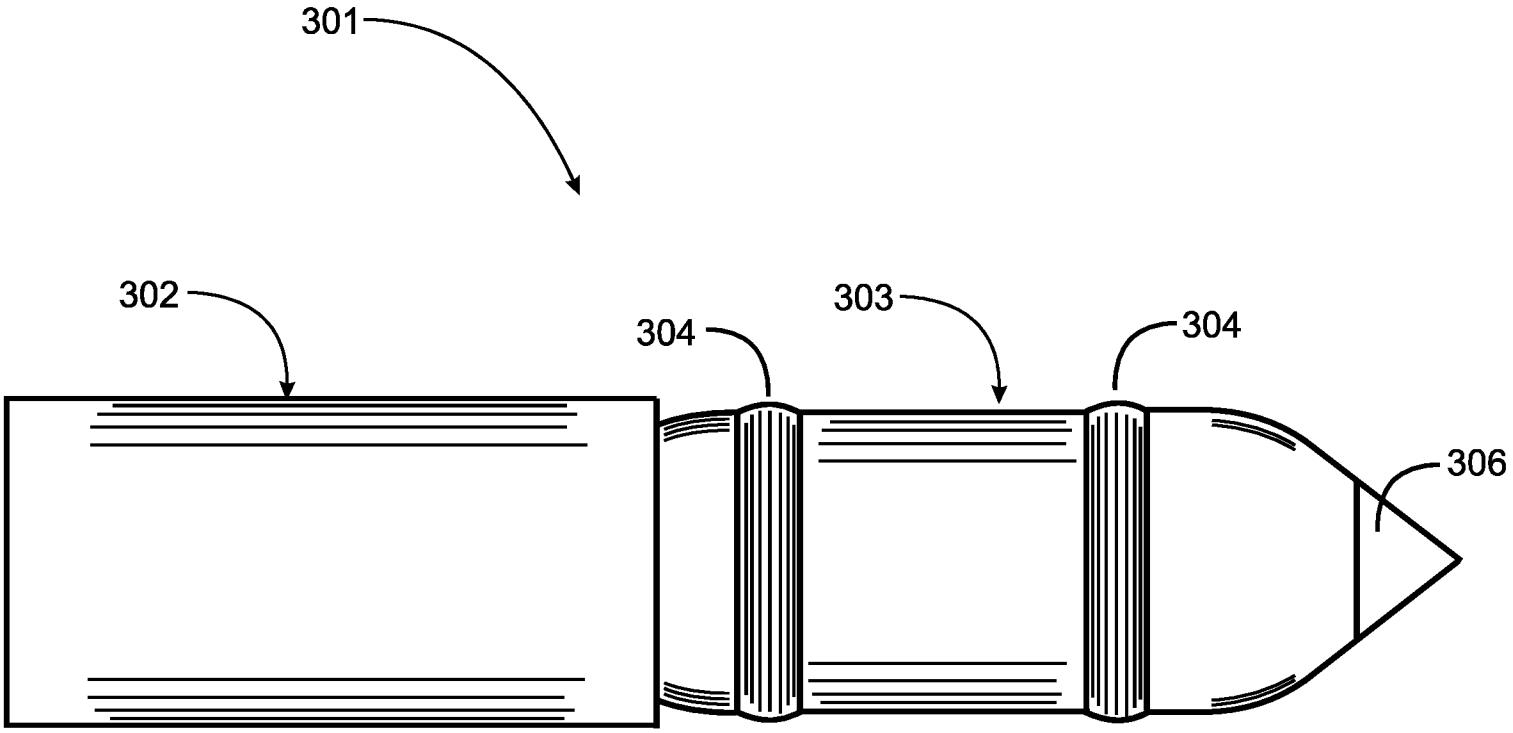
FIG. 3 is a side view of a combination projectile in an alternative embodiment of the invention.

FIG. 3 is a side view of a combination projectile 301 in an alternative embodiment of the invention. Metal body 303, with bands 304 and forward tip 306 may be identical to body 102 with tip 105 of FIGS. 1 and 2. Base wad 302 is different than base wad 103 of FIGS. 1 and 2.

Figure 4:
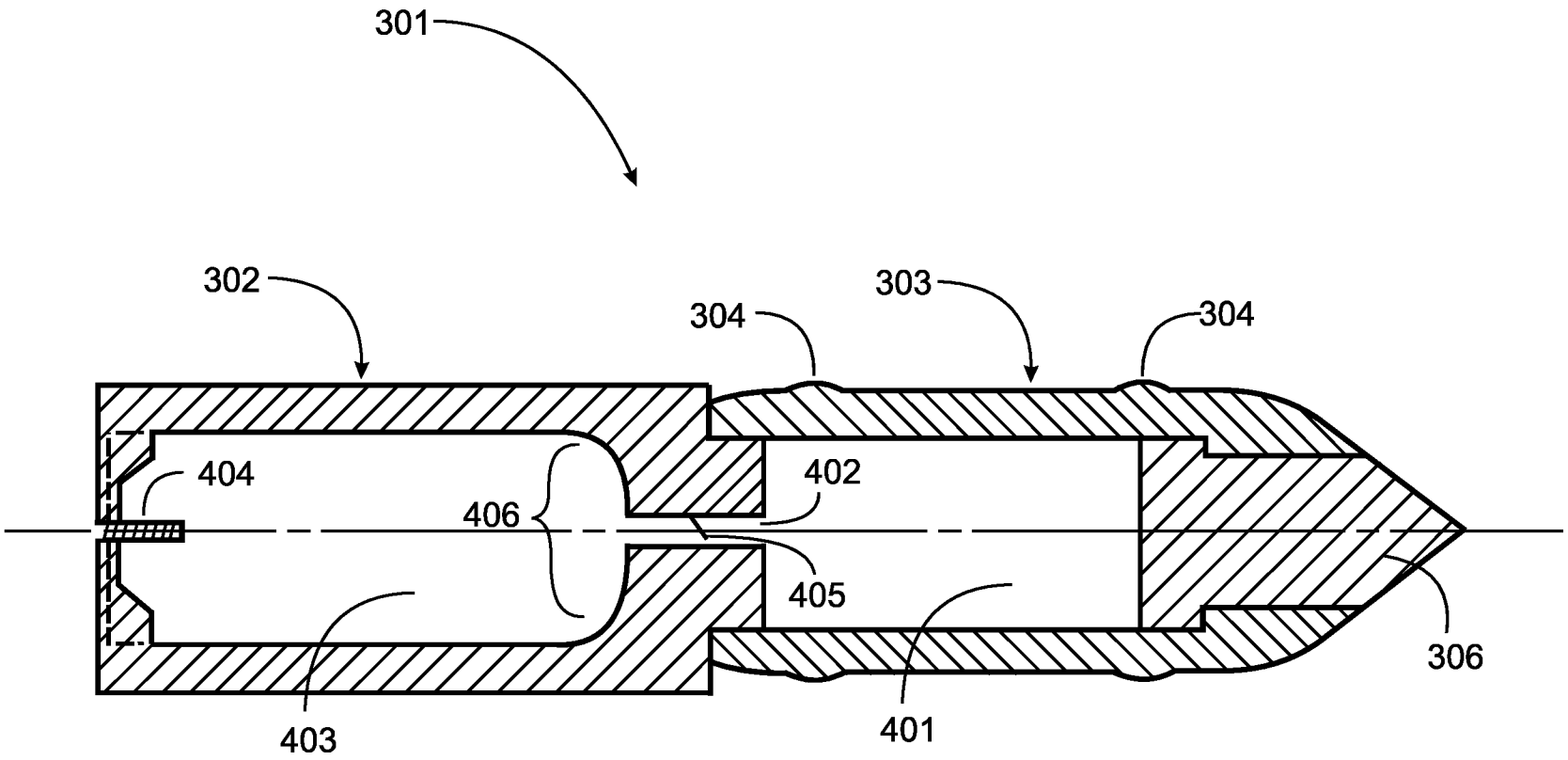
FIG. 4 is longitudinal cross-section of the projectile of FIG. 3.

FIG. 4 is a lengthwise cross section of the projectile 301. It may be seen in FIG. 4 that base wad 302 is greater in length than base wad 103 and has a hollow internal cavity 403. In some embodiments cavity 403, may be packed with explosive material and ignited in use by an ignition element 404. The base wad still has a central bore 402 like bore 107, which may have a one-way valve element 405. Ignition of the charge in cavity 403 blows out the rear of the base wad propelling the projectile along the rifled barrel and also pressurizing cavity 401 in the projectile. Operation beyond this point is the same as explained above for projectile 101. Cavity 403 has a curved end 406 termed a hemispherical head or a hemi head, as known in the art, that helps to shape and direct the expansion of gas through passage 402 to pressurize cavity 401. A hemi head in the base wad will assist in pressurizing a gas metering hole (bore 107), That curved shape of 406 is important for sealing the bore as well molding the wad out into the bore.

FIG. 5A illustrates a circular film of magnesium foil for sealing an end of a base wad in an embodiment of the invention. FIG. 5B represents a base wad 501 much the same as base wad 302 of FIG. 4, except for shape of detail 511 of a conventional shell rim for extraction and handling. A length of tape 504 is placed over bore 502 on the inside of the base wad to prevent explosive material entering bore 502, then cavity 503 is packed with explosive material and film 505 is sealed over the opening as shown. Thus, a shell is provided as shown in FIG. 5C with cavity 503 packed with explosive material and sealed by film 505. An ignition system is represented by battery 507 electrodes 508 and 509, and an ignition switch 512. Closing switch 512 powers the electrodes, and the circuit is closed by foil 505, which ignites charge 510 in cavity 503. The membrane is consumed in the ignition, and tape 506 is overcome by pressure of the expanding gas, allowing cavity 401 to pressurize as the projectile translates along the rifled barrel. Operation beyond this point is the same as described above.

A skilled person will understand that the embodiments described above with reference to the figures are all exemplary, and representative of versions of the invention that may be implemented within the overall scope of the invention but are not limiting. The scope is limited only by the claims.

The invention claimed is:

1. A projectile system, comprising:

a projectile with a metal body having a central cavity, a first outside diameter, a forward end, and a rearward end;

a plastic base wad engaged at the rearward end, the plastic base wad of solid plastic having a central bore, a first length, and a second outside diameter greater than the first outside diameter; and a rifled barrel having a third inside diameter at the tips of the rifling, the third inside diameter greater than the first outside diameter but less than the second outside diameter, and a fourth diameter at the root of the rifling greater than the second outside diameter;

wherein, in firing the projectile, expanding gas enters through the central bore and pressurizes the central cavity while the projectile translates along the rifled barrel and the metal body passes inside the rifling, avoiding metal to metal friction, while the plastic base wad fully engages the rifling, imparting rotation to the metal projectile.

2. The system of claim 1 further comprising a forward tip of explosive material or depleted uranium.

3. The system of claim 1 further comprising a one-way valve in the central bore in the plastic base wad, allowing gas into the central cavity of the metal body, but preventing gas from exiting the cavity through the central bore.

4. The system of claim 1 wherein the plastic base wad has a second length greater than the first length, an internal cavity filled with explosive material, wherein the central bore of the base wad is at a forward end of the internal cavity, and an ignition system adapted to ignite the explosive material in the internal cavity of the base wad.

5. The system of claim 4 wherein the central bore of the base wad is sealed with tape, and a rearward end of the base wad is covered with magnesium foil.

6. The system of claim 5 wherein the ignition system comprises two electrodes in contact with the magnesium foil, the electrodes connected to opposite terminals of a battery through an ignition switch, such that closing the ignition switch closes an electric circuit through the magnesium foil, igniting the explosive material.

7. A method for delivering an explosive device or an armor-penetrating element to a target, comprising:

incorporating the explosive device or armor-penetrating element in a tip of a metal body of a projectile, the metal body having a central cavity, a first outside diameter, a forward end, and a rearward end;

engaging a plastic base wad at the rearward end of the metal body, the plastic base wad of solid plastic having a central bore, a first length, and a second outside diameter greater than the first outside diameter;

placing the combination of the metal body and the plastic base wad in a first end of a rifled barrel having a third inside diameter at the tips of the rifling, the third inside diameter greater than the first outside diameter but less than the second outside diameter, and a fourth diameter at the root of the rifling greater than the second outside diameter; and igniting an explosive charge to propel the combination of the metal body and the plastic base wad along the rifled barrel;

wherein, in firing the projectile, expanding gas enters through the central bore and pressurizes the central cavity while the projectile translates along the rifled barrel and the metal body passes inside the rifling, avoiding metal to metal friction, while the plastic base wad fully engages the rifling, imparting rotation to the combination of the metal body and the plastic base wad.

8. The method of claim 7 wherein the central bore in the plastic base wad has a one-way valve, allowing gas into the central cavity of the metal body, but preventing gas from exiting the cavity through the central bore, further comprising trapping gas in the central cavity by virtue of the one way valve.

9. The method of claim 7 wherein the plastic base wad has a second length greater than the first length, an internal cavity filled with explosive material, wherein the central bore of the base wad is at a forward end of the internal cavity, and an ignition system adapted to ignite the explosive material in the internal cavity of the base wad, further comprising igniting the explosive material, driving the combination of the metal body and base wad along the rifled barrel.

10. The method of claim 9 wherein the central bore of the base wad is sealed with tape, and a rearward end of the base wad is covered with magnesium foil, further comprising igniting the explosive material by closing an ignition switch in wiring connecting electrodes in contact with the magnesium foil.

11. The method of claim 10 further comprising driving the combination metal body and plastic base wad along the rifled barrel, compressing gas in the central cavity of the metal body, until the combination exits the rifled barrel, whereupon the plastic base wad ejects from the metal body, and the compressed gas in the central cavity further propels the metal body toward the target.

* * * * *